US009423222B1

(12) United States Patent
Thomas et al.

(10) Patent No.: US 9,423,222 B1
(45) Date of Patent: Aug. 23, 2016

(54) LESS-THAN-LETHAL CARTRIDGE

(71) Applicant: Lockheed Martin Corporation, Bethesda, MD (US)

(72) Inventors: Toby D. Thomas, Southlake, TX (US); Jonathan H. Record, Grand Prairie, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/198,732

(22) Filed: Mar. 6, 2014

Related U.S. Application Data

(60) Provisional application No. 61/783,157, filed on Mar. 14, 2013.

(51) Int. Cl.
*F42B 12/46* (2006.01)
*F42B 12/02* (2006.01)

(52) U.S. Cl.
CPC ..... *F42B 12/02* (2013.01); *F42B 12/46* (2013.01)

(58) Field of Classification Search
CPC ..... F42B 12/40; F42B 12/46; F42B 12/50; F42B 12/02
USPC ..... 102/513, 515, 502, 370, 376–377, 439, 102/440, 493, 436, 521; 606/170; 428/34.1, 428/34.7, 35.7, 36.8; 383/3, 200, 207, 208
See application file for complete search history.

(56) References Cited

U.S. PATENT DOCUMENTS 2,821,924 A 2/1958 Hansen et al.
3,283,719 A 11/1966 Grandy
3,650,213 A * 3/1972 Abbott ..... F42B 5/02 102/436
3,701,533 A 10/1972 Palmer
3,802,345 A 4/1974 La Costa
3,865,038 A * 2/1975 Barr ..... F42B 12/50 102/502
3,940,605 A 2/1976 Gerber
3,952,662 A * 4/1976 Greenlees ..... F42B 7/10 102/400
3,954,060 A 5/1976 Haag et al.
4,326,463 A 4/1982 Burke et al.
4,455,943 A 6/1984 Pinson
4,594,944 A 6/1986 Rongus
4,619,202 A 10/1986 Romer et al.

(Continued)

FOREIGN PATENT DOCUMENTS

FR 2792399 A1 10/2000
WO 2013053016 A1 4/2013

OTHER PUBLICATIONS

Non-Final Office Action for U.S. Appl. No. 12/914,803, mailed Aug. 29, 2014, 11 pages.

(Continued)

*Primary Examiner* — Samir Abdosh
*Assistant Examiner* — John D Cooper
(74) *Attorney, Agent, or Firm* — Withrow & Terranova, PLLC

(57) ABSTRACT

A less-than-lethal (LTL) cartridge is disclosed. The LTL cartridge includes a case, a sabot that includes an end portion configured to fit within the case, and an interior volume configured to contain a teardrop-shaped bladder. The sabot is configured to release the teardrop-shaped bladder subsequent to exiting a barrel of a firearm. The teardrop-shaped bladder includes a leading end, a tapered body with weakened sections to facilitate rupturing of the tapered body upon impact with an object, a trailing end, and a drogue tail coupled to the trailing end.

19 Claims, 5 Drawing Sheets

(56) References Cited

U.S. PATENT DOCUMENTS

| | | | | |
|---|---|---|---|---|
| 4,638,736 | A | 1/1987 | Farmer | |
| 4,638,737 | A | 1/1987 | McIngvale | |
| 4,706,568 | A | 11/1987 | Lundwall et al. | |
| 4,777,882 | A | 10/1988 | Dieval | |
| 4,922,826 | A | 5/1990 | Busch et al. | |
| 4,957,046 | A | 9/1990 | Puttock | |
| 5,082,203 | A | 1/1992 | Baubry | |
| 5,119,715 | A | 6/1992 | Porter, Jr. et al. | |
| 5,221,809 | A * | 6/1993 | Cuadros | F42B 12/34 102/439 |
| 5,450,795 | A * | 9/1995 | Adelman | F42B 12/50 102/444 |
| 5,635,667 | A | 6/1997 | Boyer et al. | |
| 5,654,524 | A * | 8/1997 | Saxby | F42B 12/40 102/502 |
| 5,661,257 | A | 8/1997 | Nielson et al. | |
| 5,796,031 | A | 8/1998 | Sigler | |
| 5,817,969 | A | 10/1998 | Ettmuller | |
| 5,880,397 | A | 3/1999 | Crilly | |
| 6,142,056 | A | 11/2000 | Taleyarkhan | |
| 6,149,488 | A * | 11/2000 | Stark | A63H 27/10 446/220 |
| 6,223,658 | B1 | 5/2001 | Rosa et al. | |
| 6,250,226 | B1 * | 6/2001 | Leichter | F42B 12/50 102/367 |
| 6,269,747 | B1 | 8/2001 | Strandli et al. | |
| 6,283,037 | B1 * | 9/2001 | Sclafani | F42B 12/40 102/444 |
| 6,393,992 | B1 * | 5/2002 | Vasel | F41B 15/02 102/367 |
| 6,432,715 | B1 | 8/2002 | Nelson et al. | |
| 6,523,478 | B1 | 2/2003 | Gonzalez et al. | |
| 6,598,534 | B2 | 7/2003 | Lloyd et al. | |
| 6,615,739 | B2 * | 9/2003 | Gibson | F42B 10/24 102/311 |
| 6,688,032 | B1 | 2/2004 | Gonzalez et al. | |
| 6,843,179 | B2 | 1/2005 | Hunn et al. | |
| 6,871,594 | B1 | 3/2005 | Estrella | |
| 6,957,609 | B2 | 10/2005 | Ronn et al. | |
| 6,989,525 | B2 | 1/2006 | Howard | |
| 7,032,521 | B2 | 4/2006 | Ronn et al. | |
| 7,060,992 | B1 | 6/2006 | Barney | |
| 7,107,910 | B2 | 9/2006 | Hunn et al. | |
| 7,143,698 | B2 | 12/2006 | Lloyd | |
| 7,194,960 | B2 * | 3/2007 | Vasel | F41B 11/62 102/367 |
| 7,261,040 | B2 | 8/2007 | Hunn et al. | |
| 7,278,358 | B2 * | 10/2007 | Huffman | F42B 12/40 102/439 |
| 7,380,503 | B2 | 6/2008 | Williams et al. | |
| 7,490,551 | B2 | 2/2009 | Golay et al. | |
| 7,530,315 | B2 | 5/2009 | Tepera et al. | |
| 7,600,475 | B1 | 10/2009 | Friedberg | |
| 7,743,709 | B2 * | 6/2010 | Kolnik | F42B 14/064 102/521 |
| 7,752,976 | B2 | 7/2010 | Banks | |
| 7,819,065 | B2 | 10/2010 | Haeselich | |
| 7,905,178 | B2 | 3/2011 | Dryer et al. | |
| 7,930,977 | B2 | 4/2011 | Klein | |
| 8,020,492 | B1 * | 9/2011 | Kapeles | F42B 10/02 102/502 |
| 8,061,274 | B1 | 11/2011 | Hayes et al. | |
| 8,115,149 | B1 | 2/2012 | Manole et al. | |
| 8,196,514 | B2 | 6/2012 | Gustafsson et al. | |
| 8,240,252 | B2 | 8/2012 | Maljkovic et al. | |
| 8,281,720 | B2 | 10/2012 | Dindl et al. | |
| 8,286,557 | B2 | 10/2012 | Endicott et al. | |
| 8,387,538 | B2 | 3/2013 | Elder | |
| 8,415,598 | B1 | 4/2013 | Terhune et al. | |
| 8,464,639 | B2 | 6/2013 | Thomas et al. | |
| 8,511,231 | B2 | 8/2013 | Hayes et al. | |
| 8,616,127 | B2 | 12/2013 | Aliaghai et al. | |
| 8,661,981 | B2 | 3/2014 | Tepera et al. | |
| 8,708,285 | B1 | 4/2014 | Carreiro | |
| 9,068,807 | B1 | 6/2015 | Thomas et al. | |
| 2002/0174794 | A1 | 11/2002 | Lowden et al. | |
| 2005/0016412 | A1 * | 1/2005 | Vasel | F42B 7/08 102/502 |
| 2005/0066841 | A1 * | 3/2005 | Vasel | F41B 11/62 102/502 |
| 2005/0176339 | A1 * | 8/2005 | Cuisinier | A63H 27/10 446/220 |
| 2005/0188886 | A1 * | 9/2005 | Vasel | F41B 11/57 102/502 |
| 2005/0188970 | A1 * | 9/2005 | Cuisinier | F41B 3/04 124/5 |
| 2007/0068414 | A1 | 3/2007 | O'Dwyer et al. | |
| 2009/0013893 | A1 | 1/2009 | Vasel et al. | |
| 2010/0000438 | A1 | 1/2010 | Dryer et al. | |
| 2010/0126740 | A1 * | 5/2010 | Hartmann | A62C 3/025 169/70 |
| 2010/0275807 | A1 | 11/2010 | Landry et al. | |
| 2011/0023744 | A1 * | 2/2011 | Endicott, Jr. | F42B 12/40 102/502 |
| 2011/0056402 | A1 | 3/2011 | Gustavsson et al. | |
| 2011/0067593 | A1 | 3/2011 | Klein | |
| 2011/0203475 | A1 | 8/2011 | Thuman | |
| 2011/0233426 | A1 | 9/2011 | Carroll et al. | |
| 2012/0006218 | A1 | 1/2012 | Dietrich | |
| 2012/0006219 | A1 | 1/2012 | Dietrich | |
| 2012/0180686 | A1 | 7/2012 | Jones et al. | |
| 2012/0227614 | A1 | 9/2012 | Sullivan | |
| 2013/0087063 | A1 | 4/2013 | Halter | |
| 2014/0025328 | A1 | 1/2014 | Burns et al. | |
| 2014/0041545 | A1 | 2/2014 | Aw et al. | |

OTHER PUBLICATIONS

Author Unknown, "Army Ammunition Data Sheets: Artillery, Ammunition, Guns, Howitzers, Mortars, Recoilless Rifles, Grenade Launchers, and Artillery Fuzes," Technical Manual 43-0001-28, Change 15, Headquarters, Department of the Army, Oct. 2006, pp. 6-11 through 6-13.

Author Unknown, "Flight controlled Mortar (FCMortar)," Request for Information, Solicitation No. N0017813Q1010, Posted Mar. 27, 2013, Naval Surface Warfare Center, Dahlgren, Virginia, 7 pages.

Henderson, Milton E., Jr., "Fuze Efforts," AMRDEC, Weapons Development and Integration Directorate, Systems & Warheads Function, (RDMR-WDP-S), May 7, 2012, Control # FN5850, 15 pages.

Sandia National Laboratories et al., "Variable Range Less-Than-Lethal Ballistics," Final Report to the National Institute of Justice on Grant No. 2000-LT-BX-K004, Document No. 199046, U.S. Department of Justice, Jan. 2003, 66 pages.

Singh, Anant, "Degradable Taggants & Automated Multi-platform Sensor for Intelligence, Surveillance and Reconnassaince," Narrative Briefing, Command: ONR-SBIR, Topic: N07-072, TIAX LLC, 2010, Lexington, Massachusetts, 6 pages.

Non-Final Office Action for U.S. Appl. No. 13/296,408, mailed Mar. 22, 2013, 9 pages.

Final Office Action for U.S. Appl. No. 13/296,408, mailed Oct. 21, 2013, 10 pages.

Final Office Action for U.S. Appl. No. 13/296,408, mailed Feb. 10, 2014, 14 pages.

Applicant-Initiated Interview Summary for U.S. Appl. No. 13/296,408, mailed Mar. 26, 2014, 3 pages.

Advisory Action for U.S. Appl. No. 13/296,408, mailed May 1, 2014, 3 pages.

Notice of Allowance for U.S. Appl. No. 12/914,803, mailed Jan. 6, 2015, 7 pages.

Non-Final Office Action for U.S. Appl. No. 14/198,721, mailed Feb. 26, 2015, 8 pages.

Notice of Allowance for U.S. Appl. No. 14/198,721, mailed Jul. 31, 2015, 9 pages.

Notice of Allowance for U.S. Appl. No. 13/296,408 mailed Mar. 19, 2015, 8 pages.

* cited by examiner

LESS-THAN-LETHAL CARTRIDGE

RELATED APPLICATIONS

This application claims priority to and benefit of provisional patent application Ser. No. 61/783,157, filed Mar. 14, 2013, entitled "METHOD AND APPARATUS FOR SOFT PACKAGED FLUID PROJECTILE FOR LESS-THAN-LETHAL CARTRIDGE," the disclosure of which is hereby incorporated herein by reference in its entirety.

TECHNICAL FIELD

The embodiments relate to less-than-lethal cartridges used, for example, by military and law enforcement to inhibit dangerous behavior by individuals.

BACKGROUND

Less-than-lethal (LTL) cartridges are often used by the military or law enforcement to inhibit dangerous behavior, such as may be posed by an unruly crowd. Ideally, a projectile emitted from an LTL cartridge discourages behavior, but does not maim or fatally injure individuals. Unfortunately, many LTL cartridges are designed with a particular range in mind, and thus, when used at closer ranges, LTL cartridges may be fatal, or cause significant injuries to an individual.

Accordingly, there is a need for an LTL cartridge that emits a projectile that imparts a discouraging force upon an individual at both near and far ranges, but does not maim or fatally injure individuals.

SUMMARY

The embodiments relate to a less-than-lethal (LTL) cartridge that emits a projectile that impacts an individual with a sufficient force to discourage behavior, yet does not penetrate the individual. The LTL cartridge may be used at both close ranges and distant ranges. In one embodiment, the LTL cartridge includes a case that has a circumference and forms a pressure chamber. The LTL cartridge also includes a sabot that includes an end portion that is configured to fit within the case. The sabot has an interior volume that is configured to contain a teardrop-shaped bladder. The sabot is configured to release the teardrop-shaped bladder subsequent to exiting a barrel of a firearm. The teardrop-shaped bladder has a leading end, a tapered body having weakened sections to facilitate rupturing of the tapered body upon impact with an object, a trailing end, and a drogue tail coupled to the trailing end. The drogue tail, among other features, enhances stability of the teardrop-shaped bladder when in flight. In some embodiments, the leading end, the tapered body, the trailing end, and the drogue tail are all unitary and made from the same material. In some embodiments, the leading end comprises a thickened portion with respect to the tapered body.

The sabot may comprise any desired material, including, by way of non-limiting example, paper, polystyrene, syndiotactic polystyrene, polypropylene, nylon, polyethylene terephthalate, polyethylene naphthalate, polyurethane, or Styrofoam®. In some embodiments, the teardrop-shaped bladder forms an interior volume that contains a fluid. The fluid may be a liquid or a gel. In another embodiment, a less-than-lethal (LTL) munition is provided that includes a sabot, a propulsion section mated to the sabot, and a payload projectile housed within the sabot. The payload projectile includes a payload bladder and a fluid payload encapsulated in the payload bladder. In some embodiments, the sabot is sectioned to fall away subsequent to leaving the barrel of the firearm. In one embodiment, the fluid payload comprises a liquid, a gel, or a powder selected from a group consisting of tear gas (CS), chloroacetophenone (CN), capsaicin, mercaptan, dye, and paint.

In another embodiment, a method for firing a LTL cartridge from a firearm is provided. The method includes loading the firearm with the LTL cartridge, wherein the LTL cartridge comprises a case including an explosive charge and including a sabot that comprises an end portion configured to fit within the case and an interior volume configured to contain a unitary teardrop-shaped bladder. The sabot is configured to release the teardrop-shaped bladder subsequent to exiting the barrel of the firearm. The teardrop-shaped bladder includes a leading end, a tapered body having weakened sections to facilitate rupturing of the tapered body upon impact of the bladder with an object, a trailing end, and a drogue tail coupled to the trailing end. The method includes aiming the firearm in a direction, and initiating a trigger of the firearm to release a firing pin to initiate the explosive charge.

Those skilled in the art will appreciate the scope of the present disclosure and realize additional aspects thereof after reading the following detailed description of the preferred embodiments in association with the accompanying drawing figures.

BRIEF DESCRIPTION OF DRAWINGS

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the embodiments are not limited to any particular sequence of steps. The use herein of ordinals in conjunction with an element is solely for distinguishing what might otherwise be similar or identical labels, such as "first format" and "second format," and does not imply a priority, a type, an importance, or other attribute, unless otherwise stated herein.

Figure 1:
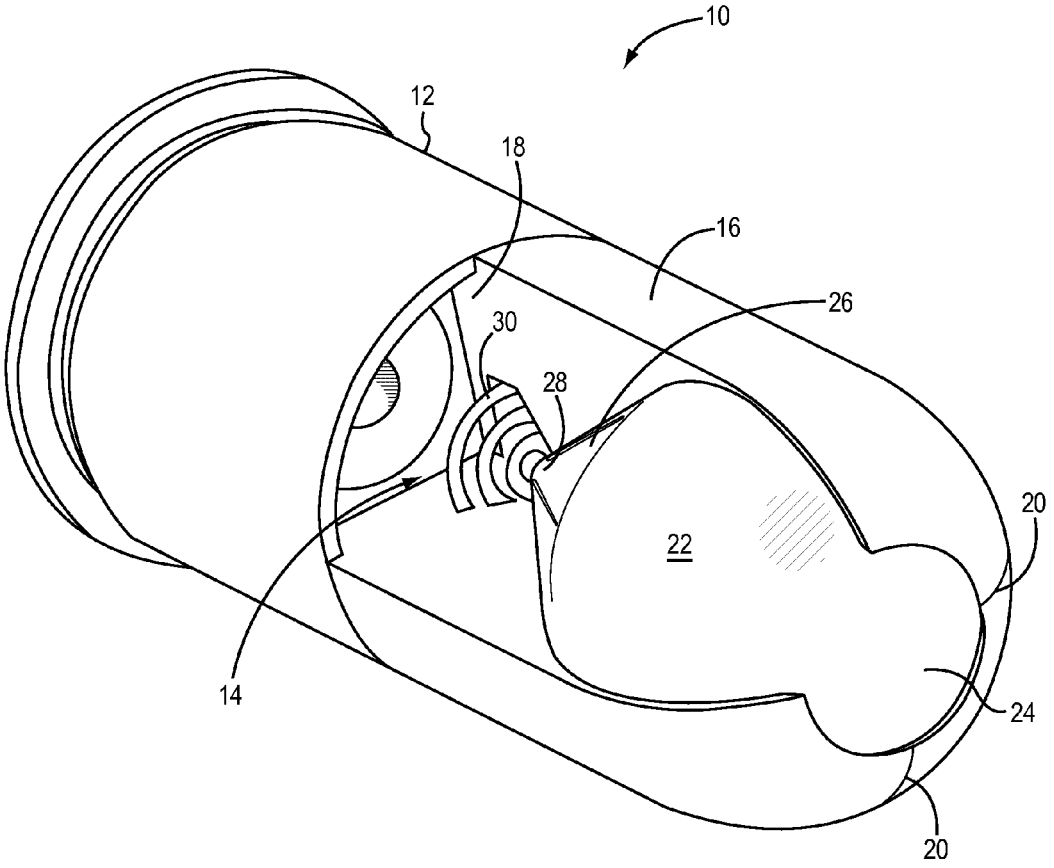
FIG. 1 is a diagram of a less-than-lethal (LTL) cartridge according to one embodiment.

FIG. 1 is a diagram of a less-than-lethal (LTL) cartridge 10 according to one embodiment. The LTL cartridge 10 may be referred to herein as an LTL munition. The LTL cartridge 10 includes a propulsion section, such as a case 12. The case 12 has a circumference associated with a size of a barrel of a firearm in which the LTL cartridge 10 will be utilized. By way of non-limiting example, the diameter of the LTL cartridge 10 may comprise 37 millimeters, as may be used by law enforcement, or 40 millimeters, as may be used by military personnel, but the embodiments are not limited to any particular size of cartridge and have utility with any type of round. The case 12 forms a pressure chamber 14 in which pressure is formed when a charge (not illustrated) is initiated.

The LTL cartridge 10 includes a sabot 16 that includes an end portion 18 that is configured to fit within the case 12. The sabot 16 may contain one or more weakened areas, such as section lines 20, such that the sabot 16 relatively quickly breaks apart and falls away shortly after exiting the barrel of a firearm.

The sabot 16 has an interior volume configured to contain a teardrop-shaped bladder 22. The teardrop-shaped bladder 22 includes a leading end 24, a tapered body 26, and a trailing end 28. A drogue tail 30 is coupled to the trailing end 28. The phrase "teardrop-shaped" is used herein to refer to a shape assumed by a falling drop of a thin liquid, which has a globular form at the leading end of the falling drop and a tapering body that leads to a pointed end at the trailing end of the falling drop.

In some embodiments, the teardrop-shaped bladder 22 is unitary, and thus, the leading end 24, the tapered body 26, the trailing end 28, and the drogue tail 30 are all made from the same material. In some embodiments, the teardrop-shaped bladder 22 is made from an elastomeric material such that the teardrop-shaped bladder 22 is elastic.

Figure 2:
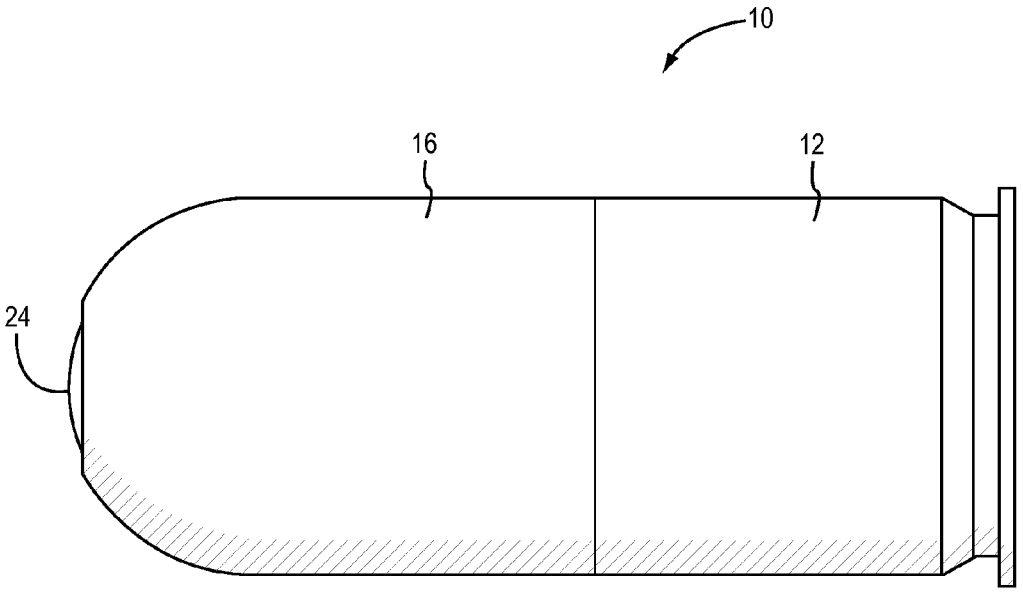
FIG. 2 is a diagram of a perspective view of an LTL cartridge according to one embodiment.

FIG. 2 is a diagram of a perspective view of the LTL cartridge 10 according to one embodiment. In this embodiment, the sabot 16 has an opening at the leading end 24 of the sabot 16 such that the leading end 24 of the teardrop-shaped bladder 22 is exposed.

Figure 3:
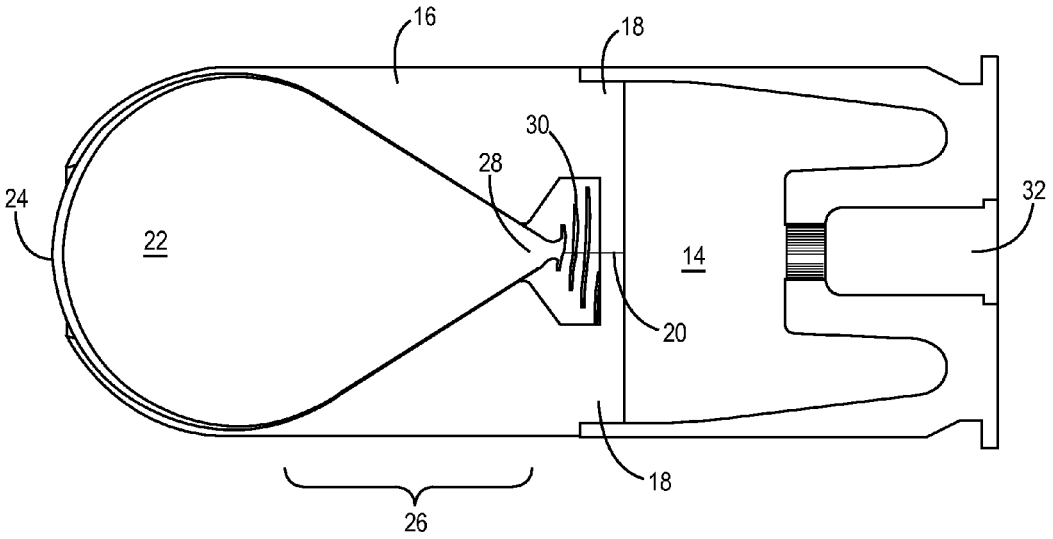
FIG. 3 is a cross-sectional view of an LTL cartridge according to one embodiment.

FIG. 3 is a cross-sectional view of the LTL cartridge 10 according to one embodiment. In this embodiment, the leading end 24 comprises a thickened portion with respect to the tapered body 26. In some embodiments, the thickened portion may have thickness greater than about $1/10^{th}$ of an inch. The tapered body 26 may have a thickness less than about $1/20^{th}$ of an inch. The change in thickness may be abrupt, or, in some embodiments, the teardrop-shaped bladder 22 comprises a non-uniform thickness throughout a length of the teardrop-shaped bladder 22, the leading end 24 having a greater thickness than the trailing end 28, an overall thickness of the tapered body 26 diminishing from the leading end 24 to the trailing end 28.

Such differing thickness helps prevent the leading end 24 from fragmenting or bursting upon impact. However, the reduced thickness of the tapered body 26 helps ensure that the tapered body 26 does fragment upon impact of the teardrop-shaped bladder 22 with an object, such as an individual. The sudden rupturing of the tapered body 26 upon impact essentially brings the mass of the teardrop-shaped bladder 22 to zero immediately after impact. This rapid diminishment of mass prevents the teardrop-shaped bladder 22 from penetrating an individual and reduces the likelihood of serious injury to such individual, yet the initial mass of the teardrop-shaped bladder 22, upon impact, imparts a substantial initial discouraging force upon the individual.

The LTL cartridge 10 may include an explosive charge 32 which, when properly triggered, such as by a firing pin of a firearm, results in detonation of the explosive charge 32 to cause a rapid increase in pressure in the pressure chamber 14. After the pressure in the pressure chamber 14 exceeds a certain level, the sabot 16 and the teardrop-shaped bladder 22 are forced out of the case 12 and down the barrel of a firearm. The sabot 16 is sectioned, or otherwise weakened, to break apart and release the teardrop-shaped bladder 22 subsequent to exiting the barrel of the firearm. In some embodiments, the sabot 16 may be made of a hardened foam, such as Styrofoam®.

Figure 4:
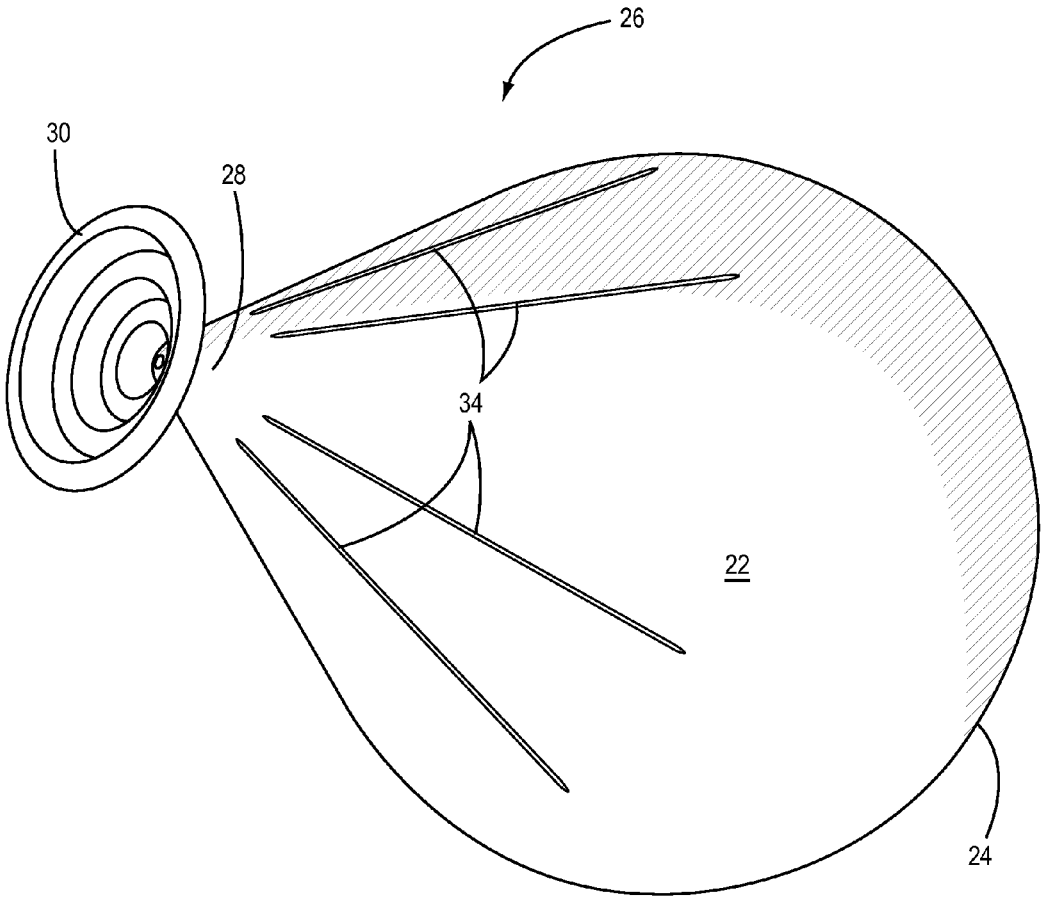
FIG. 4 is a diagram of a perspective view of a teardrop-shaped bladder according to one embodiment.

FIG. 4 is a diagram of a perspective view of the teardrop-shaped bladder 22 according to one embodiment. In this embodiment, the tapered body 26 includes a plurality of weakened sections 34 that facilitate rupturing of the tapered body 26 upon impact with an object. The weakened sections 34 may comprise any desired mechanism for weakening a material, such as score lines or other reductions in surface material thickness in a manner that increases the likelihood of a tear or rupture upon impact of the teardrop-shaped bladder 22 with an object.

The teardrop-shaped bladder 22 forms an interior volume and in some embodiments contains a fluid within the interior volume. In some embodiments, the teardrop-shaped bladder 22 is non-pressurized. In some embodiments, the fluid may comprise a liquid having a freezing point below about 10 degrees. The fluid may comprise a gel, or a liquid soap, or other biodegradable material. In some embodiments, teardrop-shaped bladder 22 may contain a liquid, a gel, or a powder selected from a group consisting of tear gas (CS), chloroacetophenone (CN), capsaicin, mercaptan, dye, and paint. The teardrop-shaped bladder 22 in conjunction with a fluid payload, as discussed above, may also be referred to herein as a payload projectile.

In operation, the teardrop-shaped bladder 22 is designed to rupture upon impact with an object, such as an individual. The teardrop-shaped bladder 22 may comprise any suitable material, such as, by way of non-limiting example, polyisoprene or natural rubber, polyisobutylene, polychloroprene (e.g., Neoprene®), polybutadiene, silicone, or the like.

Figure 5:
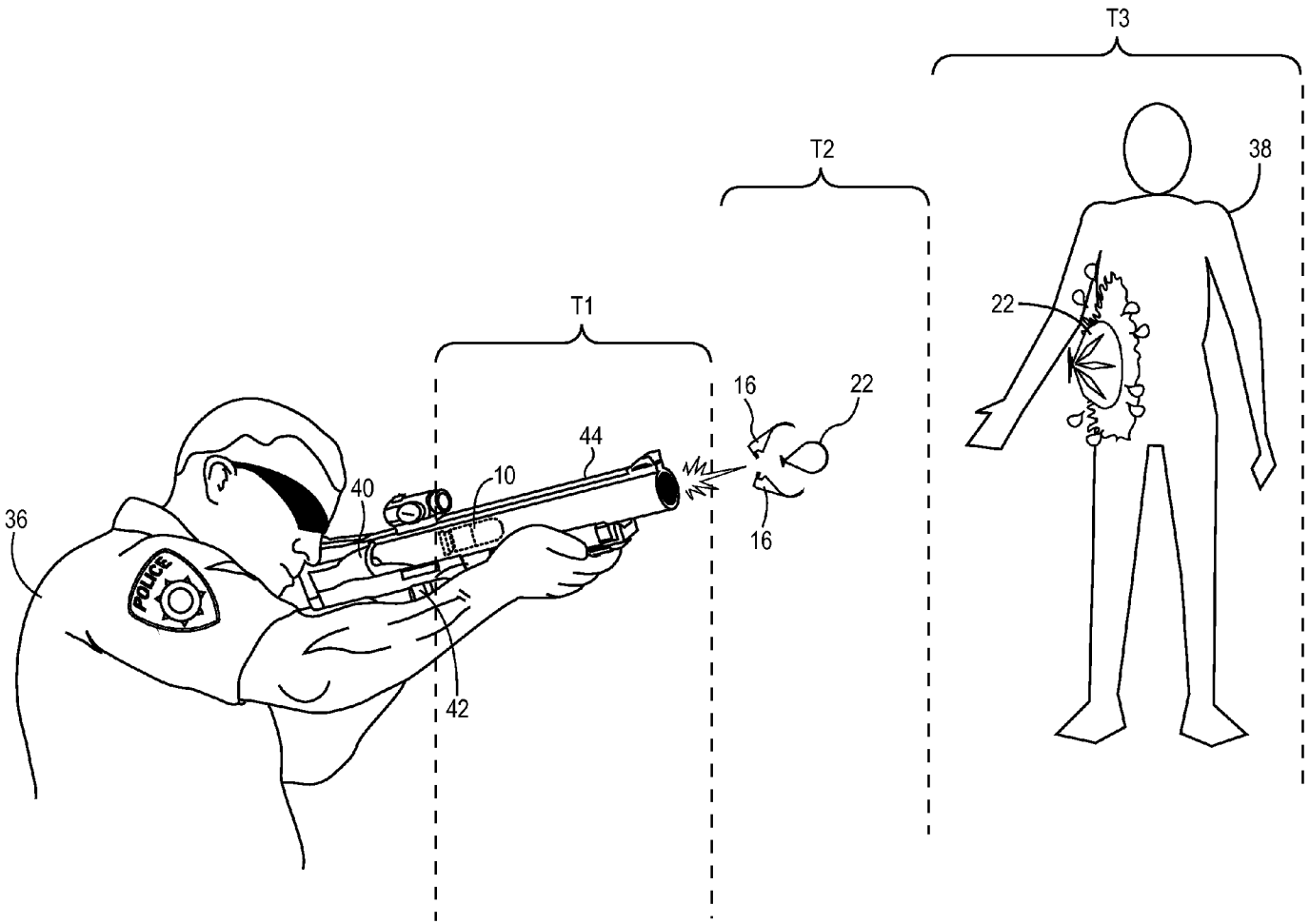
FIG. 5 is a diagram illustrating use of an LTL cartridge according to one embodiment.

FIG. 5 is a diagram illustrating use of the LTL cartridge 10 according to one embodiment. Assume that a police officer 36 is confronting an unruly individual 38. At a Time T1, the police officer 36 loads a firearm 40 with the LTL cartridge 10. The police officer 36 aims the firearm 40 in a direction toward the unruly individual 38. The police officer 36 initiates a trigger 42 of the firearm 40 to release a firing pin (not illustrated) to initiate the explosive charge 32 (FIG. 3) at the Time T1. At a Time T2, the sabot 16 and the teardrop-shaped bladder 22 have exited the end of a barrel 44 of the firearm 40. The sabot 16 begins to break apart, or otherwise fall away, from the teardrop-shaped bladder 22. At a Time T3, the teardrop-shaped bladder 22 impacts the unruly individual 38, and the tapered body 26 immediately fragments along the weakened sections 34 (FIG. 4) such that the unruly individual 38 is initially struck with a substantial force, which rapidly diminishes to no force, and thus the teardrop-shaped bladder 22 does not penetrate the body of the unruly individual 38.

Those skilled in the art will recognize improvements and modifications to the preferred embodiments of the present disclosure. All such improvements and modifications are considered within the scope of the concepts disclosed herein and the claims that follow.

What is claimed is:

1. A less-than-lethal (LTL) cartridge, comprising:
a case having a circumference and forming a pressure chamber; and
a sabot comprising:
an end portion configured to fit within the case; and
an interior volume configured to contain a teardrop-shaped bladder;
wherein the sabot is configured to release the teardrop-shaped bladder subsequent to exiting a barrel of a firearm;
the teardrop-shaped bladder, comprising:
a leading end comprising a thickened portion having a first thickness;
a tapered body having weakened sections to facilitate rupturing of the tapered body upon impact with an object, the tapered body having a second thickness less than the first thickness, and the weakened sections have a third thickness less than the second thickness;
a trailing end; and
a drogue tail coupled to the trailing end.

2. The LTL cartridge of claim 1, wherein the teardrop-shaped bladder is unitary.

3. The LTL cartridge of claim 1, wherein the first thickness is greater than 1/10 of an inch.

4. The LTL cartridge of claim 3, wherein the second thickness is less than 1/20 of an inch.

5. The LTL cartridge of claim 1, wherein the teardrop-shaped bladder comprises an elastic material.

6. The LTL cartridge of claim 1, wherein the teardrop-shaped bladder comprises a material selected from a group consisting of polyisoprene, natural rubber, polyisobutylene, polychloroprene, polybutadiene, and silicone.

7. The LTL cartridge of claim 1, wherein the sabot comprises a material selected from a group consisting of paper, polystyrene, syndiotactic polystyrene, polypropylene, nylon, polyethylene terephthalate, polyethylene naphthalate, polyurethane, and Styrofoam®.

8. The LTL cartridge of claim 1, wherein the teardrop-shaped bladder forms an interior volume, and further comprising a fluid within the interior volume.

9. The LTL cartridge of claim 8, wherein the fluid is non-pressurized.

10. The LTL cartridge of claim 8, wherein the fluid comprises a liquid having a freezing point below 10 degrees.

11. The LTL cartridge of claim 8, wherein the fluid comprises a gel.

12. The LTL cartridge of claim 8, wherein the fluid comprises a liquid soap.

13. The LTL cartridge of claim 1, wherein the teardrop-shaped bladder forms an interior volume, and further comprising a powder within the interior volume.

14. The LTL cartridge of claim 1, wherein the drogue tail has a spiral shape.

15. The LTL cartridge of claim 1, wherein the drogue tail is concentric with the teardrop-shaped bladder, the drogue tail having a first end and a second end, the first end coupled to the trailing end of the teardrop-shaped bladder;
wherein the drogue tail has a first diameter at the first end and a second diameter larger than the first diameter at the second end.

16. A method for firing a less-than-lethal (LTL) cartridge from a firearm, comprising:
loading the firearm with the LTL cartridge, the LTL cartridge comprising:
a case comprising an explosive charge, the case having a circumference and forming a pressure chamber; and
a sabot comprising:
an end portion configured to fit within the case; and
an interior volume configured to contain a teardrop-shaped bladder;
wherein the sabot is configured to release the teardrop-shaped bladder subsequent to exiting a barrel of the firearm;
the teardrop-shaped bladder, comprising:
a leading end comprising a thickened portion having a first thickness;
a tapered body having weakened sections to facilitate rupturing of the tapered body upon impact with an object, the tapered body having a second thickness less than the first thickness, and the weakened sections have a third thickness less than the second thickness;
a trailing end; and
a drogue tail coupled to the trailing end;
aiming the firearm in a direction; and
initiating a trigger of the firearm to release a firing pin to initiate the explosive charge.

17. A teardrop-shaped bladder, comprising:
a leading end comprising a thickened portion having a first thickness;
a tapered body having weakened sections to facilitate rupturing of the tapered body upon impact with an object, the tapered body having a second thickness less than the first thickness, and the weakened sections have a third thickness less than the second thickness;
a trailing end; and
a drogue tail coupled to the trailing end.

18. The teardrop-shaped bladder of claim 17, wherein the teardrop-shaped bladder comprises a material selected from a group consisting of polyisoprene, natural rubber, polyisobutylene, polychloroprene, polybutadiene, and silicone.

19. The teardrop-shaped bladder of claim 18, wherein the teardrop-shaped bladder forms an interior volume, and further comprising a fluid within the interior volume.

* * * * *